US005520201A

United States Patent [19]

Hart et al.

[11] Patent Number: 5,520,201

[45] Date of Patent: May 28, 1996

[54] PONY-TAIL HAIR CLASP

[76] Inventors: Theo T. Hart; H. Wayne Hart, both of 961 Shaffer La., Pismo Beach, Calif. 93449

[21] Appl. No.: 316,227

[22] Filed: Sep. 30, 1994

[51] Int. Cl.[6] ..... A45D 8/20

[52] U.S. Cl. ..... 132/277; 132/273; D28/42

[58] Field of Search ..... 132/275, 273, 132/277, 278, 279; D28/38, 39, 40, 41, 42, 32

[56] References Cited

U.S. PATENT DOCUMENTS

| | | | |
|---|---|---|---|
| D. 177,720 | 5/1956 | Dawson | D28/42 |
| D. 188,158 | 6/1960 | Dorr | D28/42 |
| 649,848 | 5/1900 | Koenig | 132/279 |
| 673,098 | 4/1901 | Tissier | 132/279 |
| 717,499 | 12/1902 | Gouy | 132/275 |
| 971,519 | 10/1910 | Brannen | 132/275 |
| 3,842,849 | 10/1974 | Goodman | 132/275 |

*Primary Examiner*—John G. Weiss
*Assistant Examiner*—Pedro Philogene

[57] ABSTRACT

A pony-tail hair clasp comprising a lower component having a tip end, a base end, an intermediate location therebetween, a U-shaped lower jaw extended between the tip end and the intermediate location, a pair of spaced lower teeth projected upwards from the lower jaw and defining a groove therebetween, and a lower handle extended from the second intermediate location to the base end; an upper component having a tip end, a base end, an intermediate location therebetween, a U-shaped upper jaw extended between the tip end and the intermediate location, an upper tooth projected downwards from the upper jaw and alignable with the groove, and a handle extended from the second intermediate location to the base end; a first coupling mechanism for hingably coupling the intermediate locations of the components together such that their jaws define a mouth and their handles are opposed and clenchable; and a second coupling mechanism for removably coupling the tip ends of the components together.

1 Claim, 3 Drawing Sheets

FIG 1
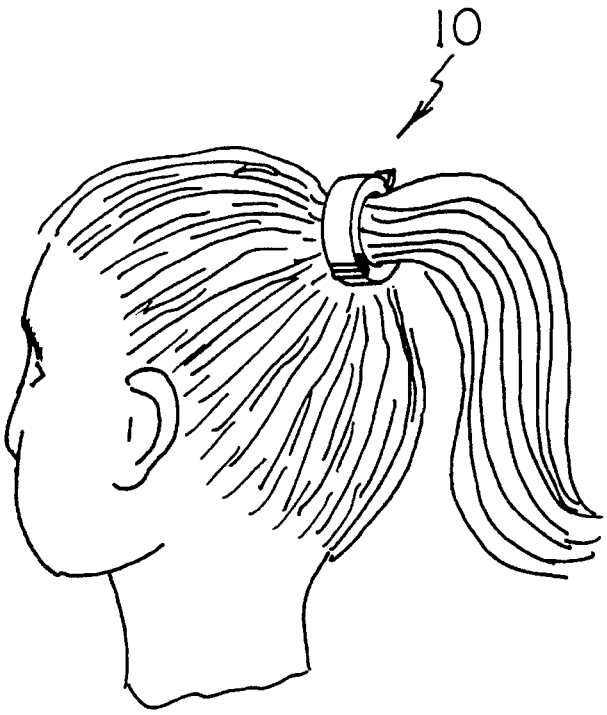
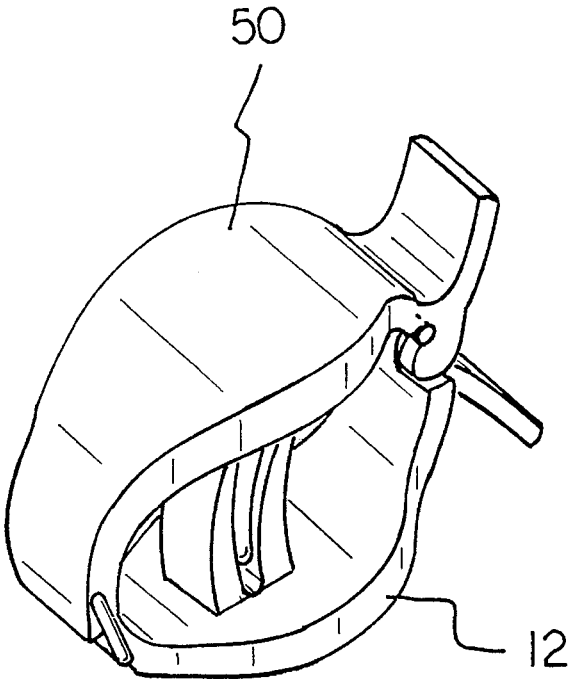
FIG 2

PONY-TAIL HAIR CLASP

BACKGROUND OF THE INVENTION

1. Field of the Invention

The present invention relates to a pony-tail hair clasp and more particularly pertains to holding a user's hair in a pony-tail type configuration with a pony-tail hair clasp.

2. Description of the Prior Art

The use of hair clasps is known in the prior art. More specifically, hair clasps heretofore devised and utilized for the purpose of holding hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,595,249 to Solomon discloses a hair clasp. U.S. Pat. No. 3,841,340 to Solomon discloses a hair clasp device. U.S. Pat. No. 3,842,849 to Goodman discloses a pony-tail holder. U.S. Pat. No. 4,753,252 to Boxer discloses a hair clip. U.S. Pat. No. 4,976,277 to Yasuda discloses a hair clip. U.S. Pat. No. 5,165,430 to Porter discloses a hair clasp construction.

While these devices fulfill their respective, particular objective and requirements, the aforementioned patents do not describe a pony-tail hair clasp that allows a user to readily and fixedly clasp his or her hair in a pony-tail type configuration.

In this respect, the pony-tail hair clasp according to the present invention substantially departs from the conventional concepts and designs of the prior art, and in doing so provides an apparatus primarily developed for the purpose of holding a user's hair in a pony-tail type configuration.

Therefore, it can be appreciated that there exists a continuing need for new and improved pony-tail hair clasp which can be used for holding a user's hair in a pony-tail type configuration. In this regard, the present invention substantially fulfills this need.

SUMMARY OF THE INVENTION

In the view of the foregoing disadvantages inherent in the known types of hair clasps now present in the prior art, the present invention provides an improved pony-tail hair clasp. As such, the general purpose of the present invention, which will be described subsequently in greater detail, is to provide a new and improved pony-tail hair clasp and method which has all the advantages of the prior art and none of the disadvantages.

To attain this, the present invention essentially comprises, in combination, a lower component. The lower component is formed of a generally rigid elastomeric material. The lower component has an upper surface, a lower surface, and a periphery interconnecting the upper surface with the lower surface. The lower component has a tip end, a base end, a first intermediate location defined between the tip end and base end, and a second intermediate location defined between the first intermediate location and the base end. The lower component has a generally U-shaped lower jaw formed of an anterior portion and a posterior portion. The anterior portion extends arcuately downwards from the tip end to the first intermediate location with the upper and lower surfaces thereof simultaneously tapering outwards. The posterior portion extends arcuately upwards from the first intermediate location to the second intermediate location with the upper and lower surfaces thereof simultaneously tapering inward. The lower component has a notch formed on the lower surface near the tip end. The lower component has a pair of symmetrically opposed and cylindrical knobs extended perpendicularly outwards from the periphery at the second intermediate location and with the knobs having a common first central axis defined therethrough. The lower component has a pair of spaced lower teeth projected upwards from the lower surface and defining a groove therebetween terminated at the first intermediate location. Each lower tooth has a rectangular cross section. The lower tooth closest to the knobs extends arcuately along a segment of a first imaginary circle centrally aligned about and perpendicular to the first central axis. The lower tooth furthest from the knobs extends arcuately along a segment of a second imaginary circle concentrically aligned about the first imaginary circle. Lastly, the lower component has a lower handle extended arcuately downwards from the second intermediate location to the base end such that it and the posterior portion of the lower jaw define a generally V-shaped configuration.

The present invention also includes an upper component. The upper component is formed of a generally rigid elastomeric material. The upper component has an upper surface, a lower surface, and a periphery interconnecting the upper surface with the lower surface. The upper component has a tip end, a base end, a first intermediate location defined between the tip end and base end, and a second intermediate location defined between the first intermediate location and the base end. The upper component has a generally U-shaped upper jaw formed of an anterior portion and a posterior portion. The anterior portion is extended upwards from the tip end to the first intermediate location with the upper and lower surfaces thereof simultaneously tapering outwards. The posterior portion is extended arcuately downwards from the first intermediate location to the second intermediate location and with the upper and lower surfaces simultaneously tapering inward. The upper component has a generally rectangular loop pivotally coupled to the tip end. The upper component has a pair of symmetrically opposed hooks extended downwards from the second intermediate location. Each hook defines a circular holding space and a channel leading thereto. The holding spaces of the hooks have a second central axis defined therethrough. The upper component has an upper tooth projected downwards from the lower surface at a location coincident with the first intermediate location. The upper tooth has a cross-section formed of opposed and symmetric bulb-shaped portions with an integral retracted portion therebetween. The lower tooth is extended arcuately along a segment of a third imaginary circle centrally aligned about and perpendicular to the second central axis and concentrically alignable between the first imaginary circle and second imaginary circle of the lower component. Lastly, the upper component has an upper handle extended arcuately upwards from the second intermediate location to the base end such that it and the posterior portion of the upper jaw define a generally V-shaped configuration.

Each hook of the upper component is removably secured about a separate knob of the lower component to hingably couple the components together such that their jaws are opposed and define a mouth and their handles are opposed. The handles are clenchable in one orientation for opening the mouth. The handles are releasable in another orientation with the clasp removably securable in the notch for closing the mouth such that the upper tooth is inserted within the groove and in contact with both of the lower teeth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pony-tail hair clasp which has all the advantages of the prior art hair clasps and none of the disadvantages.

It is another object of the present invention to provide a new and improved pony-tail hair clasp which may be easily and efficiently manufactured and marketed.

It is a further object of the present invention to provide a new and improved pony-tail hair clasp which is of durable and reliable construction.

An even further object of the present invention is to provide a new and improved pony-tail hair clasp which is susceptible of a low cost of manufacture with regard to both materials and labor, and which accordingly is then susceptible of low prices of sale to the consuming public, thereby making such a pony-tail hair clasp economically available to the buying public.

Still yet another object of the present invention is to provide a new and improved pony-tail hair clasp which provides in the apparatuses and methods of the prior art some of the advantages thereof, while simultaneously overcoming some of the disadvantages normally associated therewith.

Even still another object of the present invention is to provide a new and improved pony-tail hair clasp for holding a user's hair in a pony-tail type configuration.

Lastly, it is an object of the present invention to provide a new and improved pony-tail hair clasp comprising a lower component having a tip end, a base end, an intermediate location defined between the tip end and base end, a generally U-shaped lower jaw extended between the tip end and the intermediate location, a pair of spaced lower teeth projected upwards from the lower jaw and defining a groove therebetween, and a lower handle extended from the second intermediate location to the base end; an upper component having a tip end, a base end, an intermediate location defined between the tip end and base end, a generally U-shaped upper jaw extended between the tip end and the intermediate location, an upper tooth projected downwards from the upper jaw and alignable with the groove, and a handle extended from the second intermediate location to the base end; and first coupling means for hingably coupling the intermediate location of the lower component with the intermediate location of the upper component such that their jaws are opposed and define a mouth and their handles are opposed and clenchable in one orientation for opening the mouth and releasable in another orientation for closing the mouth such that the upper tooth is inserted within the groove; and second coupling means for removably coupling the tip ends of the components together when the mouth is closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention secured upon a user's head for holding hair in a pony-tail type configuration.

FIG. 2 is a perspective view of the preferred embodiment de-coupled from a user's head.

The same reference numerals refer to the same parts through the various Figures.

DESCRIPTION OF THE PREFERRED EMBODIMENT

Figure 3:
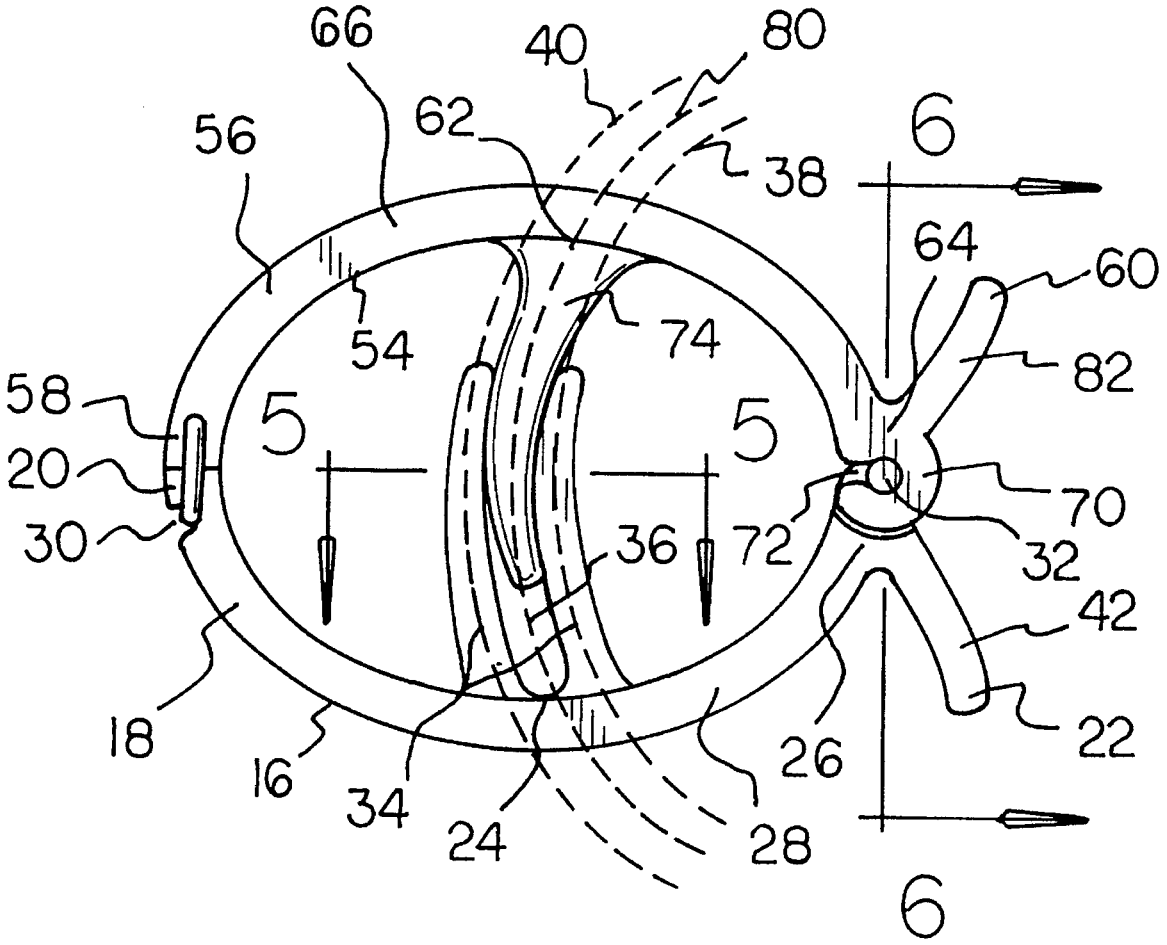
FIG. 3 is a side elevational view of the present invention.
Figure 4:
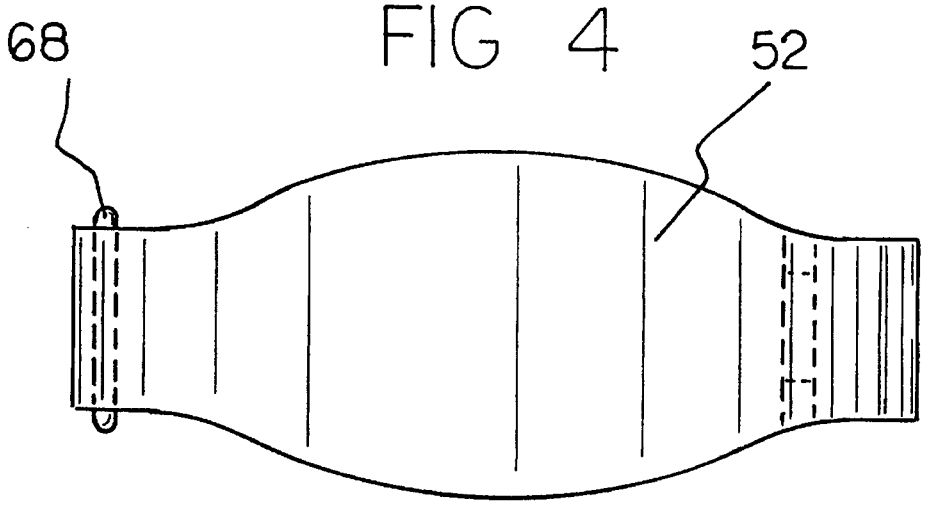
FIG. 4 is a plan view of the present invention as viewed with respect to the upper component thereof.
Figure 5:
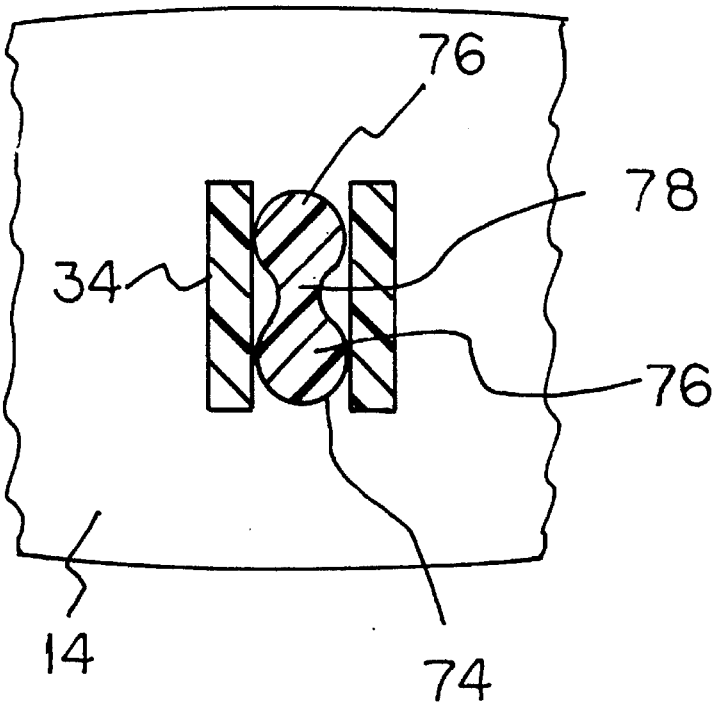
FIG. 5 is a cross-sectional view of the present invention taken along the line 5—5 of FIG. 3.
Figure 6:
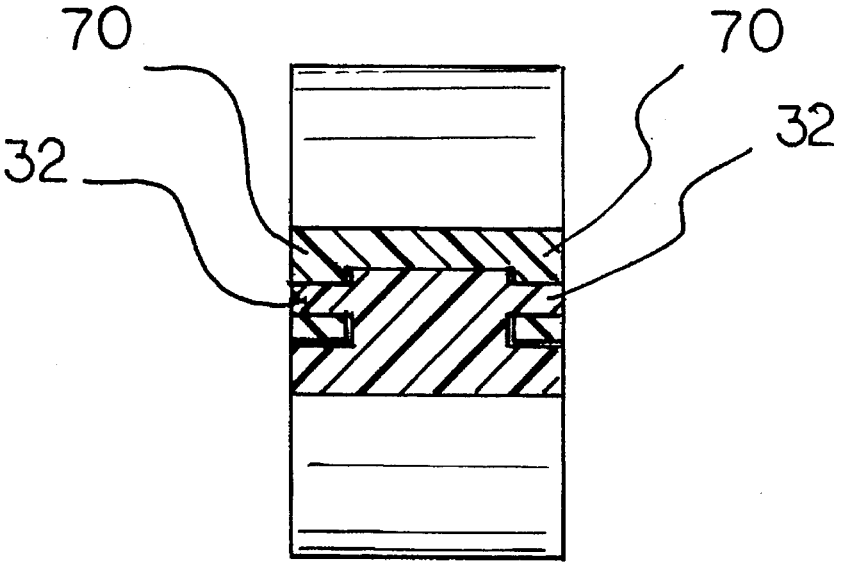
FIG. 6 is a cross-sectional view of the present invention taken along the line 6—6 of FIG. 3.

With reference now to the drawings, and in particular, to FIG. 3 thereof, the preferred embodiment of the new and improved pony-tail hair clasp embodying the principles and concepts of the present invention and generally designated by the reference number 10 will be described.

Specifically, the present invention essentially includes two major elements. The major elements are the lower component and the upper component. These elements are interrelated to provide the intended function of holding a user's hair in a pony-tail type configuration.

More specifically, it will be noted in the various Figures that the first major element is the lower component 12. The lower component is formed of a generally rigid elastomeric material such as plastic. The lower component can also be formed of a rigid material such as wood or bone. The lower component has an upper surface 14, a lower surface 16, and a periphery 18 perpendicularly interconnecting the upper surface with the lower surface. The lower component has a tip end 20, a base end 22, a first intermediate location 24 defined between the tip end and base end, and a second intermediate location 26 defined between the first intermediate location and the base end. The lower component has a generally U-shaped lower jaw 28 formed of an anterior portion and a posterior portion. The anterior portion is extended arcuately downwards from the tip end 20 to the first intermediate location 24. The upper and lower surfaces of the anterior portion are simultaneously tapered outwards from the tip end to the first intermediate location. The posterior portion is extended arcuately upwards from the first intermediate location to the second intermediate location. The upper and lower surfaces of the lower component are simultaneously tapered inward from the first intermediate location to the second intermediate location. The lower component has a notch 30 formed on the lower surface near the tip end. This notch is angled upwards towards the tip end. The notch is adapted for holding a loop therein. The lower component also includes a pair of symmetrically opposed and cylindrical knobs 32. These knobs are extended perpendicularly outwards from the periphery at the second intermediate location. The knobs have a common first central axis defined therethrough. The lower component also includes a pair of spaced lower teeth 34. The lower teeth each have a generally conical structure. The lower teeth are positioned along the middle of the lower surface and aligned along a longitudinal axis defined through the lower jaw. The lower teeth are projected upwards from the lower surface and thereby define a arcuate groove 36 therebetween. The groove is terminated at the first intermediate location. Each lower tooth has a rectangular cross-section. The lower tooth closest to the knobs extends arcuately along a segment of a first imaginary circle 38 centrally aligned about and perpendicular to the first central axis. The lower tooth furthest from the knobs extends arcuately along a segment of a second imaginary circle 40 concentrically aligned about the first imaginary circle. Thus, the groove therebetween is generally radial in shape. The lower component also includes a lower handle 42. The lower handle is extended arcuately downwards from the second intermediate location to the base end such that it and the posterior portion of the lower jaw define a generally V-shaped configuration.

The second major element is the upper component 50. The upper component is formed of a strip of generally rigid elastomeric material such as plastic. Like the lower component, the upper component can also be formed of a rigid material such as wood or bone. The upper component has an upper surface 52, a lower surface 54, and a periphery 56 perpendicularly interconnecting the upper surface with the lower surface. The upper component also has a tip end 58, a base end 60, a first intermediate location 62 defined between the tip end and base end, and a second intermediate location 64 defined between the first intermediate location and the base end. The upper component has a generally U-shaped upper jaw 66. This jaw essentially has the same size and shape as the lower jaw of the lower component. The upper jaw is formed of an anterior portion and a posterior portion. The anterior portion is extended upwards from the tip end 58 to the first intermediate location 62. The upper and lower surfaces of the upper component simultaneously taper outwards from the tip end to the first intermediate location. The posterior portion extends arcuately downwards from the first intermediate location 62 to the second intermediate location 64. The upper and lower surfaces of the posterior portion simultaneously taper inward from the first intermediate location to the second intermediate location. The upper component includes a generally rectangular loop 68. This loop is formed of an elastomeric or metal material. The loop is pivotally coupled to the tip end and is adapted to fit within the notch on the lower component. The upper component includes a pair of symmnetrically opposed hooks 70 integral with and extended downwards from the second intermediate location. Each hook defines a circular holding space and a channel 72 leading to the holding space. The holding spaces of the hooks have a second central axis defined therethrough. The upper component includes an upper tooth 74. The upper tooth has a generally conical structure. The upper tooth is positioned along the middle of the lower surface and aligned along a longitudinal axis defined through the upper jaw. The upper tooth is projected downwards from the lower surface at a location coincident with the first intermediate location. The upper tooth has a cross-section formed of opposed and symmetric bulb-shaped portions 72 with an integral retracted portion 78 extended therebetween. The lower tooth is extended arcuately along a segment of a third imaginary circle 80 centrally aligned about and perpendicular to the second central axis. The third imaginary circle is concentrically alignable between the first imaginary circle 78 and second imaginary circle 40 of the lower component. The third imaginary circle is directly alignable with the arcuate groove of the lower component. The upper component includes an upper handle 82 extended arcuately upwards from the second intermediate location to the base end such that it and the posterior portion of the upper jaw define a generally V-shaped configuration. The upper handle essentially has the same size and shape as the lower handle of the lower component and is symmetrically opposed thereto.

Each hook of the upper component is removably secured about a separate knob 32 of the lower component to hingably couple the components together. The components are coupled together such that the first central axis is collinear with the second central axis and their jaws are opposed and define a mouth with a generally oval-shaped interior portion. The handles of the components are thus opposed and clenchable in one orientation for opening the mouth. The handles are also releasable in another orientation with the clasp removably securable in the notch for closing and locking the mouth. When the mouth is closed, the upper tooth is inserted within the groove and in contact with both of the lower teeth.

When the mouth of the present invention is closed, the spacing between the open top of the groove and the connection of the upper tooth with the upper jaw is minimal. When the mouth of the present invention is closed, the spacing between the closed bottom of the groove and the tip of the upper tooth is about 0.006 inches. The oval-shaped periphery of the mouth has a major axis and a minor axis. The length of the major axis is defined from the connection of the tip ends when the mouth is closed to the second intermediate location (between the lower surfaces) and is 1⅝ inches±1/16 inch. The minor axis is defined from the center of the upper jaw to the center of the lower jaw (between the lower surfaces) and is 1⅛ inch± 1/16 inch. The third imaginary circle has a radius of about 1 1/16 inch.

To operate the present invention, the mouth is opened by clenching the handles, and portion of hair on a user's head is gathered into a bundle and placed upon the lower jaw with the lower teeth projected therethrough. The upper jaw is then pushed down upon the lower jaw such that the tip ends make contact and the upper tooth is inserted within the groove. The teeth thereby separate the bundle into two parts, and these two parts are pushed outwards towards the lower surfaces for ensuring a snug fit within the mouth. The loop is then secured within the notch, thereby locking the mouth shut and placing the bundle of hair in a pony-tail type configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pony-tail hair clasp for holding a user's hair in a pony-tail type configuration comprising, in combination:

a lower component formed of a generally rigid elastomeric material, the lower component having an upper surface, a lower surface, a periphery interconnecting the upper surface with the lower surface, a tip end, a base end, a first intermediate location defined between the tip end and base end, and a second intermediate location defined between the first intermediate location and the base end, a lower anterior portion and a lower posterior portion with the lower anterior portion extending arcuately downwards from the tip end to the first intermediate location with the upper and lower surfaces simultaneously tapering outwards and with the lower posterior portion extending arcuately upwards from the first intermediate location to the second intermediate location with the upper and lower surfaces simultaneously tapering inward, a notch formed on the lower surface near the tip end and further angled upwards toward the tip end, a pair of symmetrically opposed and cylindrical knobs extend perpendicularly outwards from the periphery at the second intermediate location and with the knobs having a common first central axis defined therethrough, and a pair of spaced lower teeth with a conical structure project upwards from the lower surface along a longitudinal axis defined between the lower anterior portion and lower posterior portion and further defining a groove therebetween terminated at the first intermediate location with each lower tooth having a rectangular cross section and with the lower tooth closest to the knobs extending arcuately along a segment of a first imaginary circle centrally aligned about and perpendicular to the first central axis and the lower tooth furthest from the knobs extending arcuately along a segment of a second imaginary circle concentrically aligned about the first imaginary circle, and a lower handle extends arcuately downwards from the second intermediate location to the base end such that it and the lower posterior portion of the lower jaw define a generally V-shaped configuration; and an upper component formed of a generally rigid elastomeric material, the upper component having an upper surface, a lower surface, a periphery interconnecting the upper surface with the lower surface, a tip end, a base end, a first intermediate location defined between the tip end and base end, and a second intermediate location defined between the first intermediate location and the base end, an upper anterior portion and an upper posterior portion with the upper anterior portion extending upwards from the tip end to the first intermediate location with the upper and lower surfaces simultaneously tapering outwards and with the upper posterior portion extending arcuately downwards from the first intermediate location to the second intermediate location and with the upper and lower surfaces simultaneously tapering inward, a generally rectangular loop pivotally coupled to the tip end, a pair of symmetrically opposed hooks extend downwards from the second intermediate location with each hook defining a circular holding space and a channel leading thereto and with the holding spaces of the hooks having a second central axis defined therethrough, an upper tooth projects downwards from the lower surface at a location coincident with the first intermediate location along a longitudinal axis defined between the upper anterior portion and upper posterior portion with the upper tooth having a cross-section formed of opposed and symmetric bulb-shaped portions with an integral retracted portion therebetween and with the lower tooth extending arcuately along a segment of a third imaginary circle centrally aligned about and perpendicular to the second central axis and concentrically alignable between the first imaginary circle and second imaginary circle of the lower component, and an upper handle extends arcuately upwards from the second intermediate location to the base end such that it and the upper posterior portion of the upper jaw define a generally V-shaped configuration, and with each hook removably secured about a separate knob of the lower component to hingably couple the components together such that their jaws are opposed and define a mouth with an oval shaped interior portion and their handles are opposed and clenchable in one orientation for opening the mouth and releasable in another orientation with the clasp removably securable in the notch for closing the mouth such that the upper tooth is inserted within the groove and in contact with both of the lower teeth.

* * * * *